US011395572B2

(12) United States Patent
Tidwell

(10) Patent No.: US 11,395,572 B2
(45) Date of Patent: Jul. 26, 2022

(54) FLOOR CLEANING DEVICE AND METHOD

(71) Applicant: Frankie Deniece Tidwell, Augusta, AR (US)

(72) Inventor: Frankie Deniece Tidwell, Augusta, AR (US)

( * ) Notice: Subject to any disclaimer, the term of this patent is extended or adjusted under 35 U.S.C. 154(b) by 0 days.

(21) Appl. No.: 16/884,991

(22) Filed: May 27, 2020

(65) Prior Publication Data

US 2021/0161353 A1 Jun. 3, 2021

Related U.S. Application Data

(63) Continuation-in-part of application No. 15/909,776, filed on Mar. 1, 2018, now abandoned.

(60) Provisional application No. 62/465,632, filed on Mar. 1, 2017.

(51) Int. Cl.

| | |
|---|---|
| ***A47L 13/12*** | (2006.01) |
| ***A47L 13/258*** | (2006.01) |
| ***A47L 13/46*** | (2006.01) |

(52) U.S. Cl.

CPC ..... *A47L 13/12* (2013.01); *A47L 13/258* (2013.01); *A47L 13/46* (2013.01); *A46B 2200/3073* (2013.01)

(58) Field of Classification Search

CPC ..... A47L 13/12; B25G 3/30
USPC ..... 15/105, 111, 114, 115, 118
See application file for complete search history.

(56) References Cited

U.S. PATENT DOCUMENTS

| | | | | |
|---|---|---|---|---|
| 1,583,358 | A | 5/1926 | Emily | |
| 1,609,414 | A * | 12/1926 | Thomas | B25G 3/00 15/143.1 |
| 1,610,657 | A | 12/1926 | Burgee | |
| 3,668,850 | A | 6/1972 | Horkey | |
| 5,172,447 | A * | 12/1992 | Tomm | A47L 13/24 15/159.1 |
| 5,581,839 | A * | 12/1996 | Ferrell, Jr. | A47L 13/42 15/143.1 |
| 2004/0231700 | A1 | 11/2004 | Bell et al. | |
| 2005/0132517 | A1 | 6/2005 | Weckemann et al. | |
| 2012/0030889 | A1* | 2/2012 | Pannell | A47L 13/08 15/111 |
| 2014/0182074 | A1* | 7/2014 | Mark | B25G 3/18 15/105 |
| 2015/0082565 | A1 | 3/2015 | Rizzi et al. | |
| 2017/0238782 | A1* | 8/2017 | Varnai | A46B 5/005 |
| 2019/0059681 | A1* | 2/2019 | Weliver | A47L 13/24 |

(Continued)

FOREIGN PATENT DOCUMENTS

| | | |
|---|---|---|
| GB | 25226 | * 11/1913 |
| GB | 9194 | * 4/1915 |

(Continued)

*Primary Examiner* — Anne M Kozak
*Assistant Examiner* — Jonathan G Santiago Martinez
(74) *Attorney, Agent, or Firm* — Runyan Law; Charles Runyan

(57) ABSTRACT

A floor cleaning device and method include mop head, including cleaning fibers, a corner brush coupled to an extendable member and extendable from a center of the mop head, and an inner handle including knob for engaging and disengaging a locking mechanism for locking corner brush in position. Floor cleaning device and method is useful for cleaning hard-to-reach areas of floors without the need for excessive bending or hand scrubbing.

13 Claims, 8 Drawing Sheets

(56) References Cited

U.S. PATENT DOCUMENTS

2020/0015648 A1* 1/2020 Gwen ..... A46B 15/0081

FOREIGN PATENT DOCUMENTS

GB 12841 * 4/1915
GB 155174 * 12/1920

* cited by examiner

FLOOR CLEANING DEVICE AND METHOD

CROSS-REFERENCE TO RELATED APPLICATION(S)

The present application is related to and claims priority to U.S. Non-Provisional patent application Ser. No. 15/909,776, filed on Mar. 1, 2018, pending, which is related to and claims priority to U.S. Provisional Patent Application Ser. No. 62/465,632 filed Mar. 1, 2017. Both of these documents are incorporated by reference in their entirety.

BACKGROUND OF THE INVENTION

The following includes information that may be useful in understanding the present disclosure. It is not an admission that any of the information provided herein is prior art nor material to the presently described or claimed inventions, nor that any publication or document that is explicitly or implicitly referenced is prior art.

TECHNICAL FIELD

The present invention generally relates to the field of cleaning means of existing art and, more specifically, relates to mops and heads.

RELATED ART

Cleaning is, at times, a tedious and tiresome chore that most people must attend to. When it comes to cleaning floors, the generally accepted equipment is most commonly a broom and mop. While a mop is ideal for cleaning large, hard surfaces such as tile floors, mop heads are often bulky and difficult to get into tight spaces such as corners or around baseboards in a home.

Cleaning floors commonly calls for a person to get down on the floor and clean corners and baseboards manually with a rag or other, smaller cleaning device. Getting down onto a surface such as a tile floor can be taxing and strenuous. Furthermore, such physical strain may not be possible for those suffering from disability and injury, as well as the elderly. A suitable solution is desired.

U.S. Pat. No. 6,675,427 to Andrea Chiapelli relates to a mop including mop head having a scrub material. The described mop including mop head having a scrub material includes a mop having mop head supported on a handle and including mop head base and a mop body. The mop body is defined by a plurality of mop strands supported on the base. A scrubber element is supported on the base, centrally within the mop body. The scrubber element further has opposing faces on a scrubber body located at laterally opposing sides to define abrasive scrubbing surfaces. A single attachment element provides a simple and cost-effective way to attach the scrubber element simultaneously with attachment of the mop strands. The scrubber element further is engaged with mop head base to bias the scrubber element into a folded configuration folded so that the opposing faces are facing away from the mop handle thereby enabling a mop user to easily manipulate the scrubber element provided for removal of difficult stains, etc. by applying downward pressure to the handle.

SUMMARY OF THE INVENTION

Given the preceding disadvantages inherent in the known mops and heads art, the present disclosure provides a novel floor cleaning device and method. The general purpose of the present disclosure, described in greater detail below, is to provide an efficient and effective floor cleaning device and method.

A floor cleaning device is disclosed. The floor cleaning device includes mop head, including cleaning fibers, a corner brush coupled to an extendable member and extendable from a center of the mop head, and an inner handle including knob for engaging and disengaging a locking mechanism for locking corner brush in position.

According to another embodiment, a method for cleaning a floor is also disclosed. The method for cleaning a floor includes mopping a floor with mop head until a user encounters a corner, twisting knob to disengage locking mechanism, extending the inner extendable handle to position corner brush in the extended position, twisting a knob to engage locking mechanism, and cleaning the corner using corner brush.

BRIEF DESCRIPTION OF THE DRAWINGS

The figures which accompany the written portion of this specification illustrate embodiments and methods of use for the present disclosure, a floor cleaning device, constructed and operative according to the teachings of the present disclosure.

Figure 1:
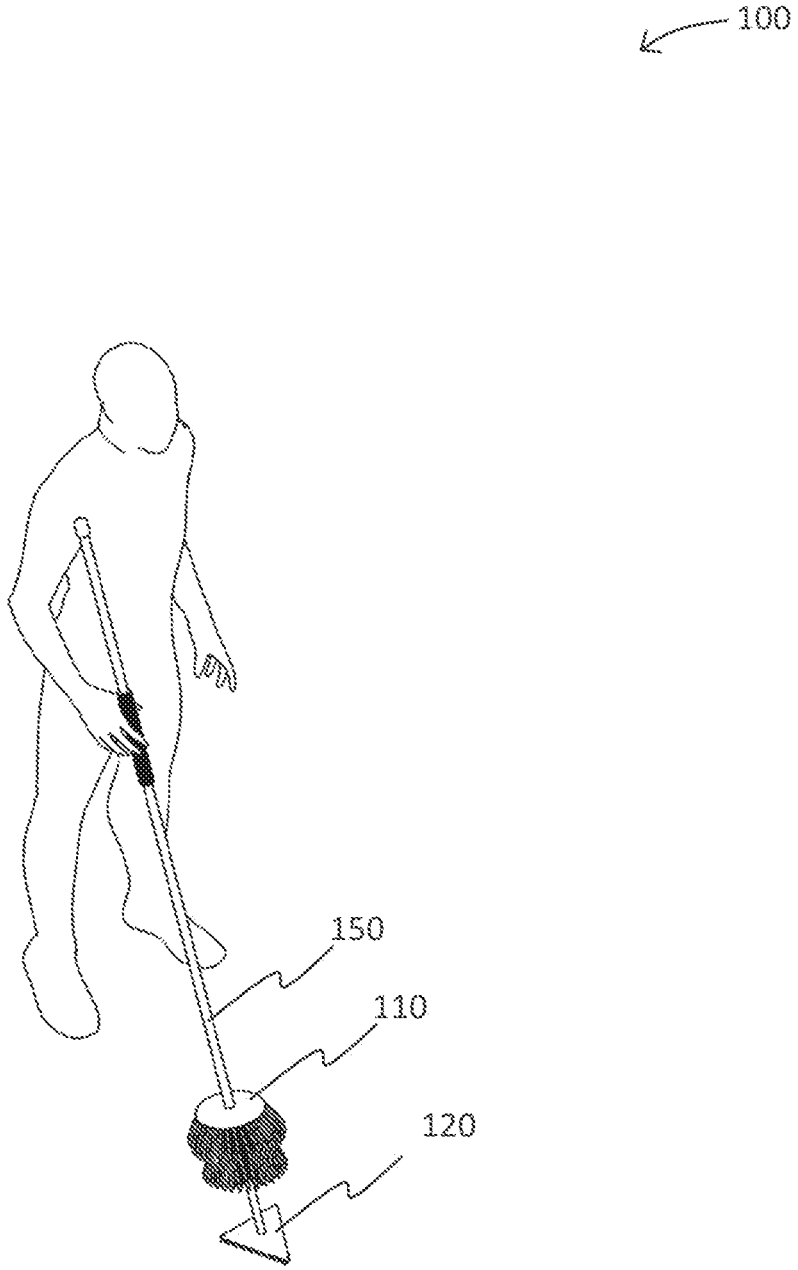
FIG. 1 is a perspective view of a floor cleaning device during an 'in-use' condition, according to an embodiment of the disclosure.

The various embodiments of the present invention are described below with the appended drawings.

DETAILED DESCRIPTION

As discussed above, embodiments of the present disclosure relate to mops and heads and, more particularly, to a floor cleaning device as used to improve the clean hard-to-reach areas of a floor and adjacent surfaces.

Generally, a floor cleaning device may include a swab mop, a corner brush, a brush extension-and-retraction mechanism, and a handle. The corner brush may be configured to extend from and retract into the handle. The corner brush may further be configured to extend to an approximate length of twelve to eighteen inches. The brush extension-and-retraction mechanism may include a push-button or a knob for operation, and alternatively knob.

TABLE OF PART NUMBERS floor cleaning device 100
mop head 110
corner brush 120
inner handle 130
outer handle 150
cleaning fibers 200
cleaning bristles 201
opening 202
locking mechanism 404
knob 406
floor 500
step one 501
step two 502
step three 503
step four 504
step five 505
step six 506
step seven 507
step eight 508
surface 601
joint 605
taper lock 610
upper part 615
upper end 650
tapered cavity 655
wall 656
joint 700
lower end 701
surface 705
socket 710
surface 715
tip 716
surface 717
space 720
top end 810
base 815
elongate post 820
outer surface 825
inner surface 840
outer threads 1402
inner threads 1404
outer threads 1406
Inner threads 1408
lower end 1410

Referring now more specifically to the drawings by numerals of reference, FIGS. 1-4 show various views of a floor cleaning device 100.

FIG. 1 shows a floor cleaning device 100 during an 'in-use' condition. Here, floor cleaning device 100 may clean hard-to-reach areas of a floor without the user having to get down on the floor and scrub them by hand. As illustrated, floor cleaning device 100 may include mop head 110 that includes cleaning fibers 200. Furthermore, floor cleaning device 100 may include a corner brush 120 coupled to an inner handle 130 that is extendable from a center of mop head 110. Floor cleaning device 100 may include an inner handle 130 including knob 406 for engaging and disengaging a locking mechanism 404 for locking corner brush 120 in position.

Figure 2:
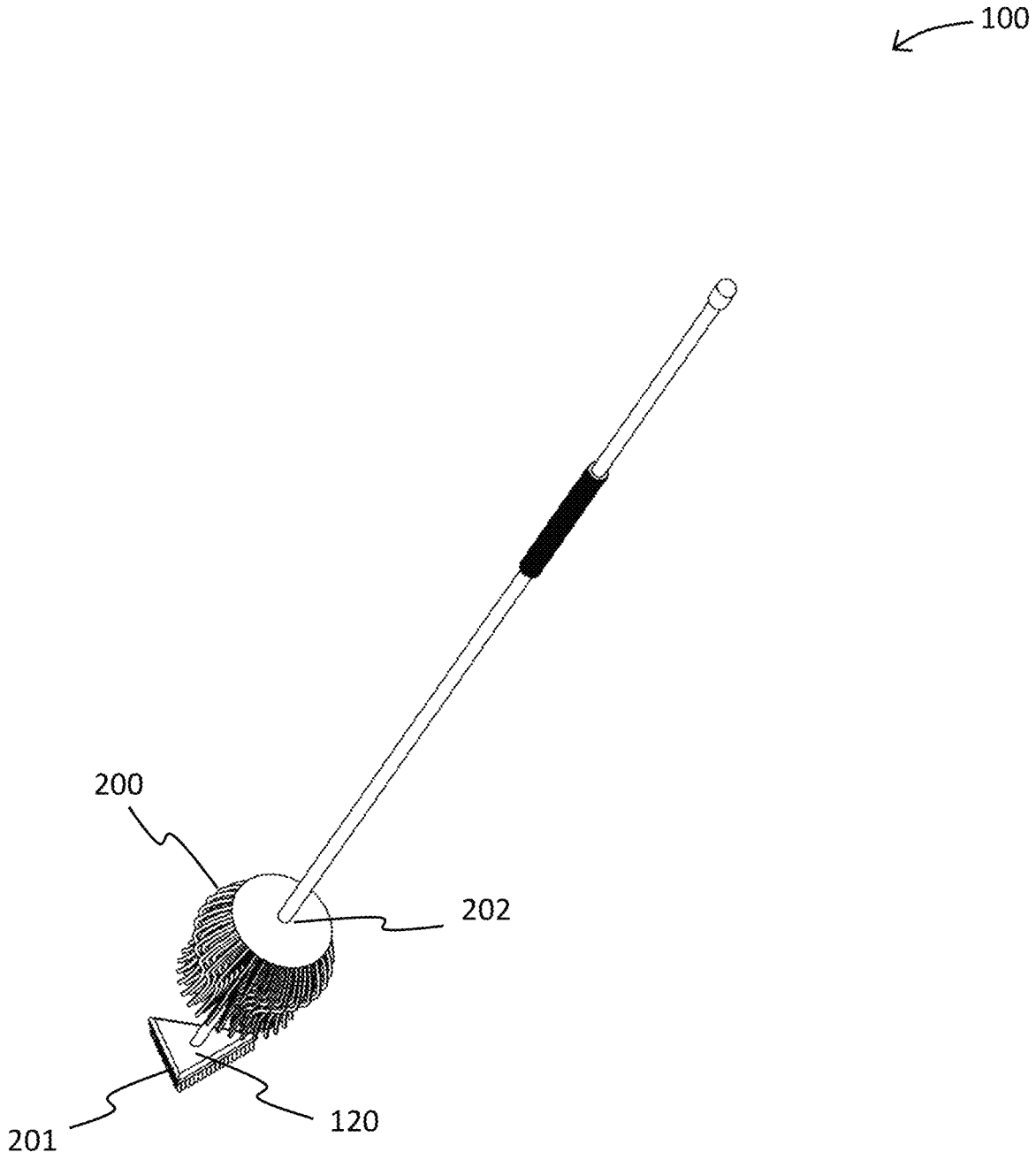
FIG. 2 is a perspective view of the floor cleaning device of FIG. 1, according to an embodiment of the present disclosure.

FIG. 2 shows the floor cleaning device 100 of FIG. 1. As above, floor cleaning device 100 may include mop head 110. Mop head 110 may include cleaning fibers 200 configured to suit the overall construction of mop head 110. In some versions, cleaning fibers 200 may also include a sufficiently absorbent material to facilitate removing cleaning products from a surface. And cleaning fibers 200 may be shorter than the length of inner handle 130. Mop head 110 may also include opening 202 positioned centrally to cleaning fibers 200 to allow passage of inner handle 130.

Corner brush 120 may include cleaning bristles 201. Corner brush 120 may further comprise triangularly arranged cleaning bristles 201 to facilitate reaching a corner between two walls. And corner brush 120 may be coupled to inner handle 130 so that corner brush 120 may extend and retract with inner handle 130. Corner brush 120 may mount angled relative to inner handle 130 to facilitate comfortable use. In some versions, facilitate comfortable use means facilitate use that does not involve excessive bending.

Figure 3:
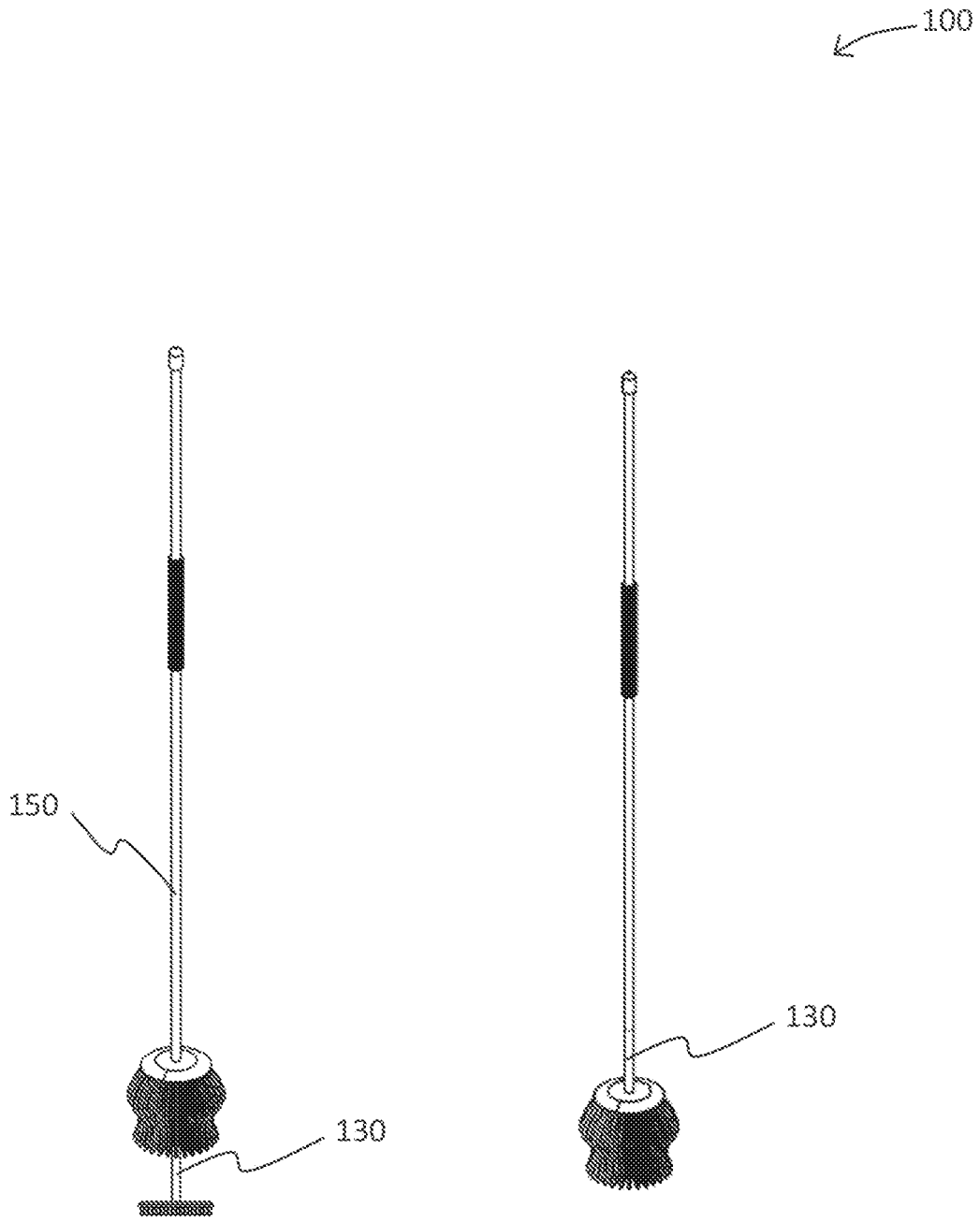
FIG. 3 is a perspective view of the floor cleaning device of FIG. 1, according to an embodiment of the present disclosure.

FIG. 3 is a perspective view of floor cleaning device 100 and shows that corner brush 120 may mount to inner handle 130, which may connect to inner handle 130. Inner handle 130 may extend through opening 202. As inner handle 130 is extended, it passes through opening 202 that sits centrally on mop head 110. Since corner brush 120 connects to inner handle 130, the extension of inner handle 130 extends corner brush 120. Inner handle 130 is significantly (such as 10, 20, 30, 40, or 50%) longer than cleaning fibers 200. In some versions, this greater length helps prevent cleaning fibers 200 from interfering with or with using corner brush 120. In some versions, corner brush 120 fits into a corner between two adjacent walls. In these or other versions, corner brush 120 is smaller than mop head 110. In some versions, cleaning fibers 200 comprise the same material as cleaning bristles 201. In these or other embodiments, cleaning fibers 200 have the same shape as cleaning bristles 201.

Figure 4:
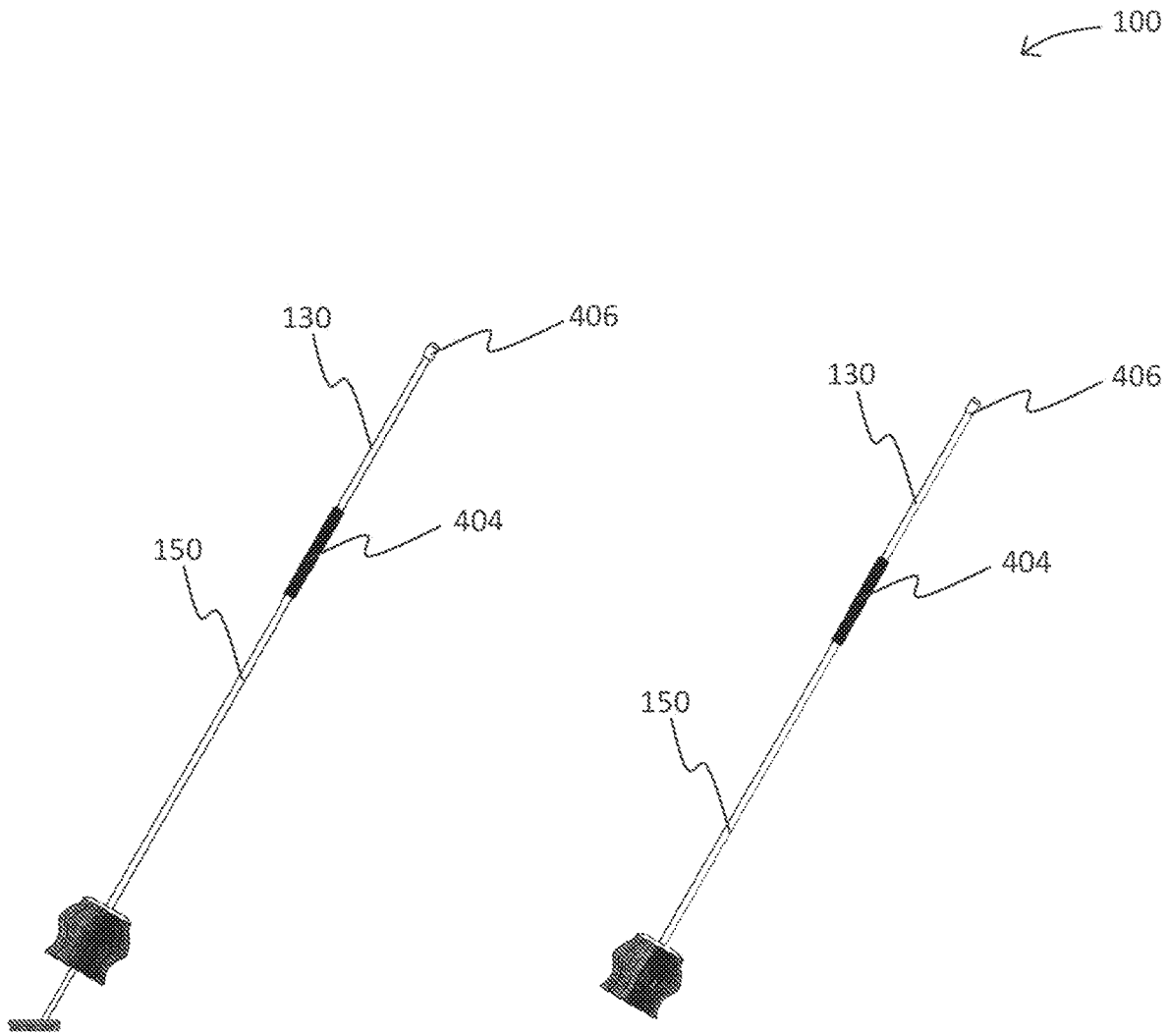
FIG. 4 is a perspective view of the floor cleaning device of FIG. 1, according to an embodiment of the present disclosure.

FIG. 4 is also a perspective view of floor cleaning device 100. In this version, inner handle 130 passes through outer handle 150 and locking mechanism 404. Knob 406 attaches to the upper end of inner handle 130 and connects to locking mechanism 404 to facilitate locking and unlocking locking mechanism 404. Specifically, locking mechanism 404 sits at the end of outer handle 150, and knob 406 sits at the end of inner handle 130. In some versions, knob 406 is spaced apart from locking mechanism 404. Inner handle 130 may be positioned among a plurality of operative modes, including extended and retracted modes or positions. Twisting knob 406 may engage and disengage locking mechanism 404. Other methods of engaging and disengaging locking mechanism 404 may suit the design, construction, or needs of floor cleaning device 100.

Figure 5:
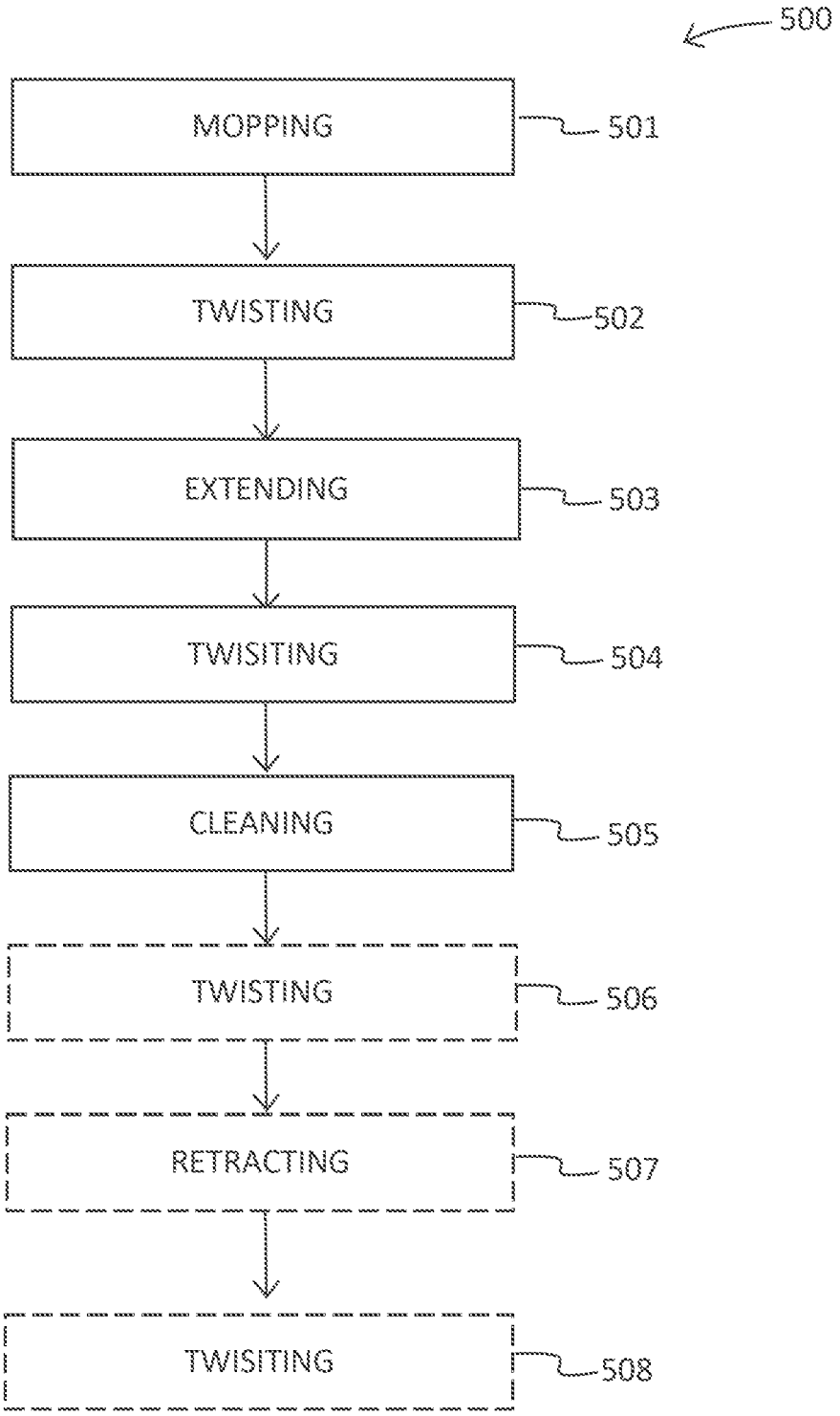
FIG. 5 is a flow diagram illustrating a method of use for cleaning a floor using the present invention, according to an embodiment of the present disclosure.

FIG. 5 is a flow diagram illustrating a method for cleaning a floor 500, according to an embodiment of the present disclosure. In particular, the method for cleaning a floor 500 may include one or more components or features of floor cleaning device 100, as described above. As illustrated, the method for cleaning a floor 500 may include the steps of step one 501, mopping a floor with a mop head until a user encounters a corner; step two 502, twisting the knob to disengage locking mechanism; step three 503, extending inner extendable handle to extend the corner brush; step four 504, twisting the knob to engage the locking mechanism; step five 505, cleaning a corner using the corner brush; step six 506, twisting the knob to disengage locking mechanism; step seven 507, retracting inner extendable handle to retract the corner brush; step eight 508, twisting the knob to engage the locking mechanism.

Figure 6:
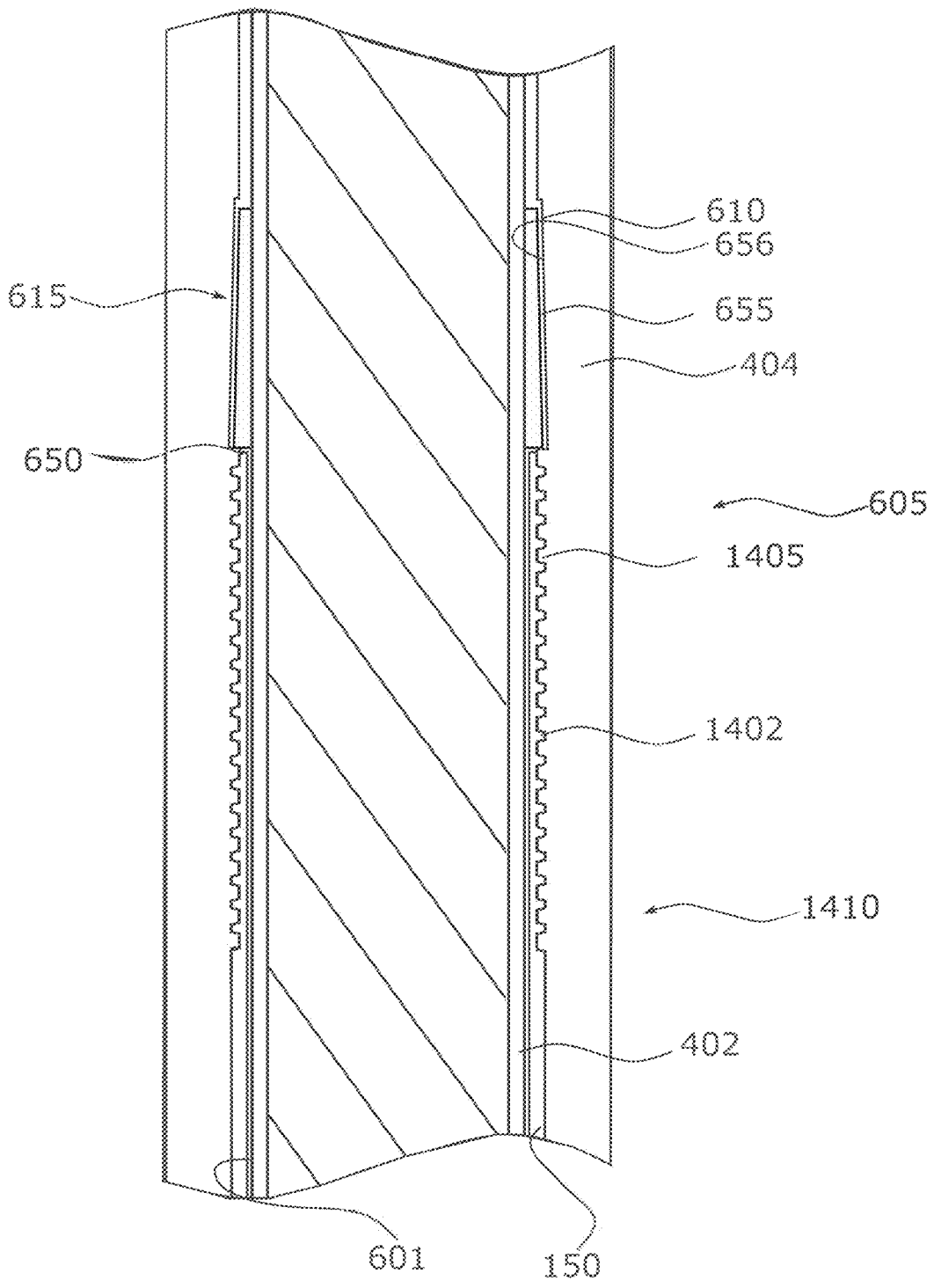
FIG. 6 is a close-up view of the joint between locking mechanism and outer handle of the floor cleaning device of FIG. 1, according to an embodiment of the present disclosure.

FIG. 6 depicts a close-up view of joint 605 between locking mechanism 404 and outer handle 150. In this version, outer handle 150 has outer threads 1402 on the outside surface 601 of its upper end 650. Locking mechanism 404 has inner threads 1404 near its lower end 1410. In some versions, inner threads 1404 on lower end 1410 begin a distance upward from lower end 1410. Inner handle 130 extends upward from locking mechanism 404 and downward through locking mechanism 404 into and through outer handle 150. Taper lock 610 sits above inner threads 1404. In some versions, taper lock 610 is cylindrical and fits over inner handle 130. Taper lock 610, along the upper part 615 of taper lock 610, tapers inward such that the inner diameter of taper lock 610 remains substantially constant while the outer diameter of upper part 615 tapers to a reduced diameter.

Taper lock 610 abuts upper end 650 of outer handle 150. Outer handle 150 substantially prevents taper lock 610 from moving downward along inner handle 130. Locking mechanism 404 has a tapered cavity 655 upward from inner threads 1404. Cavity 655 provides clearance for taper lock 610. In some versions, locking mechanism 404 threads onto outer handle 150. This causes upper end 650 to push against the bottom of taper lock 610. At that point, further movement causes taper lock 610 to move further into tapered cavity 655 until it contacts wall 656. Further threading causes upper end 650 to push against the bottom of taper lock 610 hard enough to cause taper lock 610 to wedge between wall 656 and inner handle 130 securing inner handle 130 in place relative to outer handle 150. Thus, inner handle 130 is locked in place by locking mechanism 404.

Figure 7:
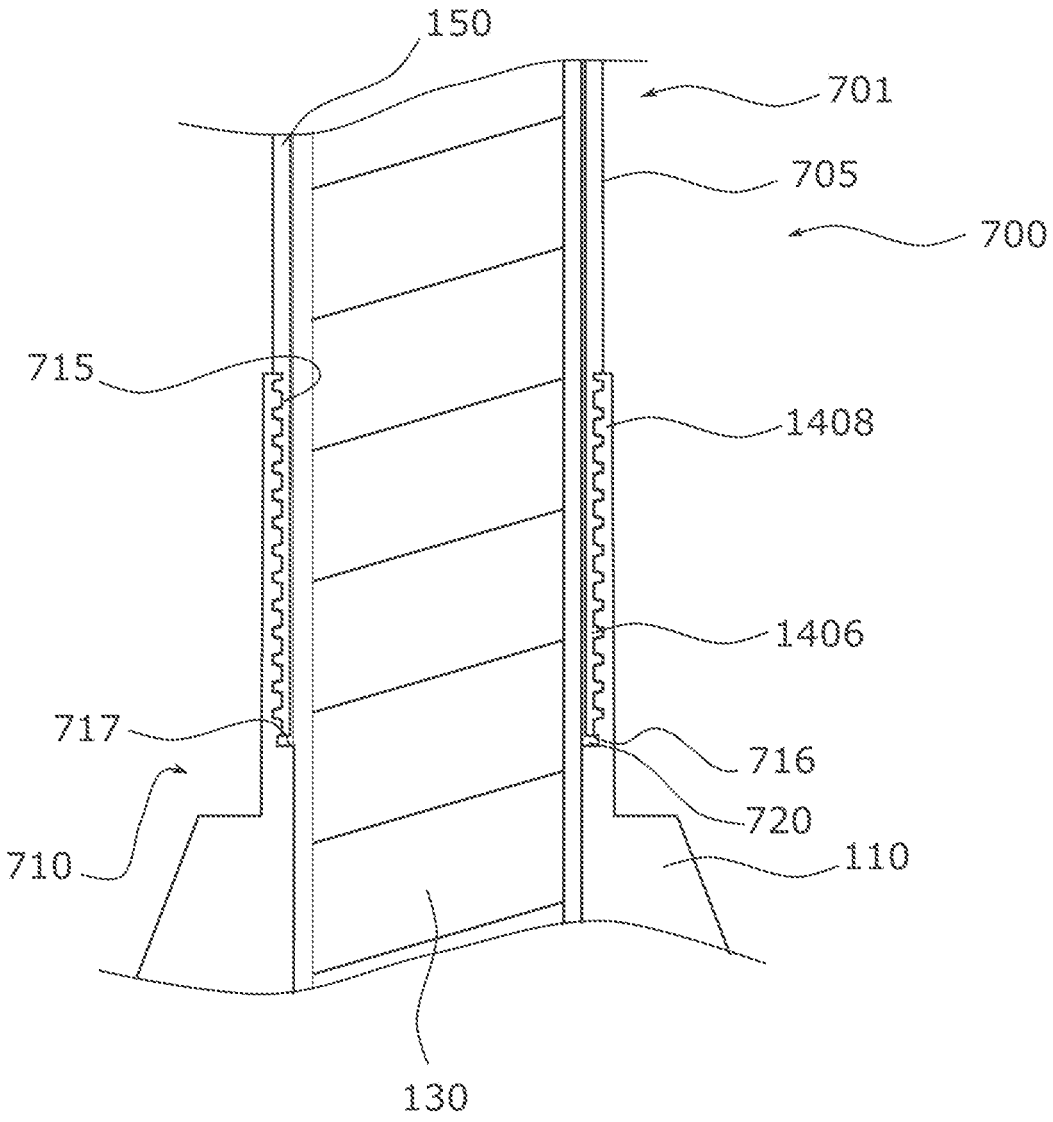
FIG. 7 depicts a close-up view of the joint between mop head and outer handle of the floor cleaning device of FIG. 1, according to an embodiment of the present disclosure.

FIG. 7 depicts a close-up view of the joint 700 between mop head 110 and outer handle 150. The lower end 701 of outer handle 150 comprises outer threads 1406 on outside surface 705 of outer handle 150. Mop head 110 has a socket 710 that comprises inner threads 1408 on inside surface 715 of socket 710. Threads 1408 receive threads 1406 to attach mop head 110 to outer handle 150. In some versions, threads 1406 extend into threads 1408 far enough to cause tip 716 to contact surface 717. In other versions, threads 1406 do not extend into threads 1408 far enough to cause tip 716 to contact surface 717. In these versions, space 720 sits between tip 716 and surface 717. Sometimes, space 720 facilitates assembly of mop head 110 onto outer handle 150.

Figure 8:
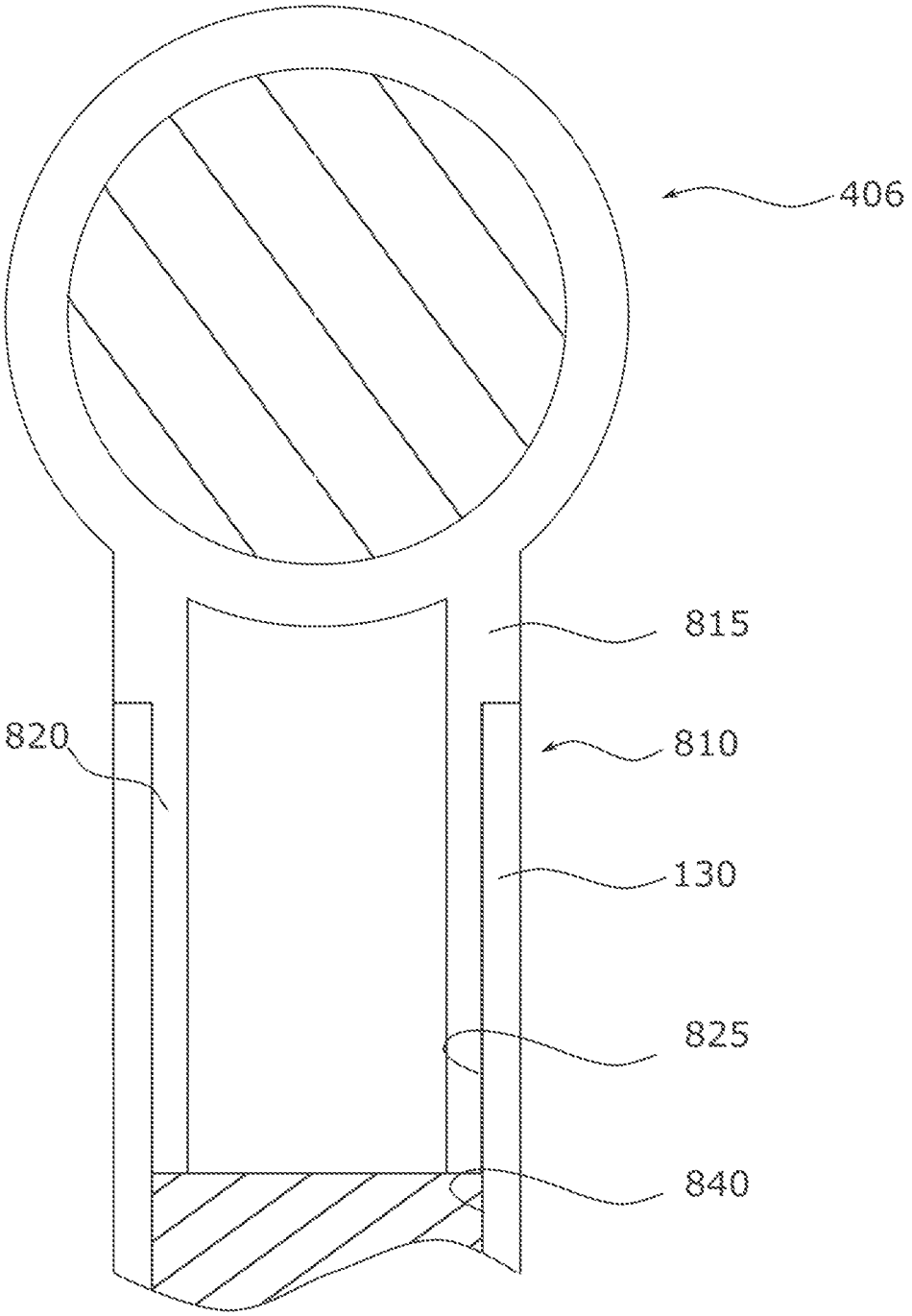
FIG. 8 depicts a top end of the inner handle of the floor cleaning device of FIG. 1, according to an embodiment of the present disclosure.

FIG. 8 depicts a top end 810 of inner handle 130. Knob 406 connects to top end 810. Knob 406 has base 815 and an elongate post 820 extending downward from base 815 into inner handle 130. Elongate post 820 is necked down and has a smaller diameter than base 815. As assembled, inner surface 840 of inner handle 130 contacts outer surface 825 of elongate post 820. In some versions, this contact results in a friction fit between knob 406 and inner handle 130. In other versions, an adhesive or glue is used on inner surface 840, outer surface 825, or both to secure elongate post 820 into inner handle 130.

What is claimed is:

1. A floor cleaning device comprising:

an outer handle having an upper outer handle end and a lower outer handle end;

an inner handle;

a mop head including cleaning fibers connected to the outer handle;

a corner brush that is extendable from the mop head coupled to the inner handle;

a corner-brush locking mechanism having a locked position and an unlocked position, wherein the mechanism is disposed on the outer handle and around the inner handle;

and a knob connected to the inner handle, wherein the inner handle extends through the outer handle and an opening in the mop head, the locking mechanism has a threaded connection to the upper outer-handle end, and a tapered cavity corresponding to a taper lock disposed within the locking mechanism and the mop head connects to the lower outer-handle end.

2. The device of claim 1, wherein the taper lock surrounds the inner handle.

3. The device of claim 2, wherein moving the upper outer-handle end toward the taper lock causes the locking mechanism to move from the unlocked position to the locked position.

4. The device of claim 3, wherein rotation of the locking mechanism onto the outer handle moves the upper outer-handle end toward the taper lock.

5. The device of claim 4, wherein the taper lock has a cylindrical lower region and a tapered upper region.

6. The device of claim 5, wherein the taper lock has a uniform inner diameter.

7. The device of claim 6, wherein in the locked position, the upper outer-handle end pushes the taper lock between the inner handle and the tapered cavity.

8. The device of claim 7, wherein the inner handle has a fully extended position that extends the corner brush a first distance, an intermediate position that extends the corner brush a second distance less than the first distance, and a fully retracted position that retracts the corner brush.

9. The device of claim 8, wherein the corner brush mounts angled to the inner handle.

10. The device of claim 9, wherein the cleaning fibers are shorter than the first distance.

11. The device of claim 10, wherein the corner brush comprises triangularly arranged cleaning bristles.

12. A method of cleaning a floor comprising the steps of:

providing a floor cleaning device having an outer handle having an upper outer handle end and a lower outer handle end;

an inner handle;

a mop head including cleaning fibers connected to the outer handle;

a corner brush that is extendable from the mop head coupled to the inner handle;

a corner-brush locking mechanism having a locked position and an unlocked position, wherein the mechanism is disposed on the outer handle and around the inner handle;

a knob connected to the inner handle;

a taper lock disposed within the locking mechanism surrounding the inner handle and having a cylindrical lower region, a uniform inner diameter, and a tapered upper region;

wherein the inner handle extends through the outer handle and an opening in the mop head, the locking mechanism has a threaded connection to the upper outer-handle end, moving the upper outer-handle end toward the taper lock causes the locking mechanism to move from the unlocked position to the locked position, rotation of the locking mechanism onto the outer handle moves the upper outer-handle end toward the taper lock, the locking mechanism has a tapered cavity corresponding to the tapered upper region, in the locked position the upper outer-handle end pushes the taper lock between the inner handle and the tapered cavity, and the mop head connects to the lower outer-handle end;

mopping a floor with the mop head;

stopping at a corner between two walls;

disengaging the locking mechanism;

extending the inner handle to extend the corner brush;

engaging the locking mechanism;

and cleaning a corner with the corner brush.

13. The method of claim 12, further comprising the steps of:

disengaging the locking mechanism;

retracting the inner handle to retract the corner brush;

and engaging the locking mechanism.

* * * * *